US007445437B1

(12) United States Patent
Kawazoe

(10) Patent No.: US 7,445,437 B1
(45) Date of Patent: Nov. 4, 2008

(54) SCROLL TYPE FLUID MACHINE HAVING A FIRST SCROLL WRAP UNIT WITH A SCROLL MEMBER AND A SCROLL RECEIVING MEMBER, AND A SECOND SCROLL WRAP UNIT ENGAGED WITH THE FIRST SCROLL WRAP UNIT

(75) Inventor: Shinji Kawazoe, Yokohama (JP)

(73) Assignee: Scroll Giken LLC, Kanagawa (JP)

( * ) Notice: Subject to any disclaimer, the term of this patent is extended or adjusted under 35 U.S.C. 154(b) by 0 days.

(21) Appl. No.: 11/812,328

(22) Filed: Jun. 18, 2007

(51) Int. Cl.
*F03C 2/00* (2006.01)
*F03C 4/00* (2006.01)
*F04C 2/00* (2006.01)

(52) U.S. Cl. ..... 418/55.2; 418/55.1; 418/58

(58) Field of Classification Search ..... 418/6, 418/55.1–55.6, 57, 58, 59, 188
See application file for complete search history.

(56) References Cited

U.S. PATENT DOCUMENTS 1,376,291 A * 4/1921 Rolkerr ..... 418/55.2
3,989,422 A * 11/1976 Guttinger ..... 418/55.2
6,179,590 B1 * 1/2001 Honma et al. ..... 418/55.1

FOREIGN PATENT DOCUMENTS

DE 3716017 A1 * 12/1987 ..... 418/55.2
JP 54124310 A * 9/1979
JP 07019186 A * 1/1995
JP 09133087 A * 5/1997
JP 2004286025 A * 10/2004

OTHER PUBLICATIONS

Etsuo Morishita et al., "Study for Scroll Fan and Blower", Japan machinery society (B edition), vol. 54, No. 498 (S63-2), monograph No. 87-0436B, Feb. 1988.

* cited by examiner

*Primary Examiner*—Theresa Trieu
(74) *Attorney, Agent, or Firm*—Wenderoth, Lind & Ponack, L.L.P.

(57) ABSTRACT

A scroll type fluid machine includes a housing, a first scroll unit arranged rotatably in the housing and a second scroll unit rotating with rotation of the first scroll unit and gyrating relative to the first scroll unit to vary volumes of compression spaces. The first scroll unit includes a first wrap group including two end plates with support shafts supported rotatably by the housing and scrolled wraps arranged uniformly. The second scroll unit includes a cylindrical outer peripheral ring portion held slidably between the end plates of the first scroll unit, a connection block portion located in a center portion and a second wrap group having plural scrolled wraps extending from the ring portion to the connection block portion to define insertion spaces into which the wraps of the first wrap group are inserted and, with the first wrap group, forming compression spaces.

7 Claims, 5 Drawing Sheets

SCROLL TYPE FLUID MACHINE HAVING A FIRST SCROLL WRAP UNIT WITH A SCROLL MEMBER AND A SCROLL RECEIVING MEMBER, AND A SECOND SCROLL WRAP UNIT ENGAGED WITH THE FIRST SCROLL WRAP UNIT

BACKGROUND OF THE INVENTION

This invention relates to a scroll type fluid machine comprising a first scroll and a second scroll which performs a gyrating movement relative to the first scroll relatively.

JP 09-133087 A discloses a whole system rotation scroll type fluid machine in which scrolled wraps extend from a drive scroll end plate and a follower scroll end plate, respectively, and are engaged with each other. A drive scroll is gyrated relative to a follower scroll to make closed spaces formed by rotation of the both scrolls move from a peripheral side to an inner side so as to reduce volume of the closed spaces, and in which sucked fluid is compressed and discharged.

JP2004-286025 A by this inventor discloses a scroll type fluid machine which comprises a casing; a follower scroll unit which is constituted of at least an outer peripheral block held on the casing rotatably and a follower wrap extending spirally from the outer peripheral block inwardly; a drive scroll unit which comprises a drive wrap engaging with the follower wrap, a pair of end plates gripping and fixing the drive wrap and holding the follower wrap slidably and a drive shaft supporting the casing rotatably and eccentrically relative to the follower scroll unit in order to rotate the end plates and which defines compression spaces with the follower scroll unit; an intake opening formed in the outer peripheral block and communicating with the compression spaces; and a discharge opening formed in the drive shaft and communicating with the compression spaces.

A monograph (Japan machinery society (B adition) volume 54, No. 498 (S63-2), monograph No. 87-0436B "Study for Scroll Fan and Blower") discloses that a fan or a blower is constituted by combining balance type bladed wheels in which two scrolls are used so that one of the wheels directly connects to a motor and another of the wheels is followed by a side wall of the scroll.

In the whole system rotation scroll type fluid machine disclosed in JP 09-133087 A, the follower scroll rotates with rotation of the drive scroll and gyrates relative to the drive scroll in order to reduce the volume of the closed spaces. However, because thrust load acts on the end plates in a direction pushing the end plates away from each other, there is a disadvantage in that a large load is applied to bearings. Besides, in the case that a volume of the closed space is increased in order to increase discharge volume, the scroll wraps have to be elevated, but in this case, since radial load is applied perpendicularly to an axis at a middle position of the wrap's height, a disadvantage arises in that an upsetting moment is increased in the case of the cantilever type arrangement as shown in JP 09-133087.

Thus, in JP 2004-286025 A, the inventor disclosed a scroll type fluid machine which can increase the volume of compression spaces because the thrust load is set off with strength of the drive scroll's wrap so as not to act as a thrust load to the bearings by means of providing a pair of end plates so as to grasp the both sides of the drive scroll's wrap and make the follower scroll's wrap rotatable between the both end plates, so that the volume of the compression space can be increased.

A scroll type fluid machine disclosed in the monograph is that: because two wraps with the same shape are used in a drive scroll side and a follower scroll side respectively and they are combined so that they are deviated by $\pi/2$ (90°), their end portions are deviated by $\pi/2$ (90°), so that there is a disadvantage such that parts without contributing to compression are arisen.

In the scroll type fluid machine disclosed in JP 2004-286025 A, it is possible to increase discharge ability by further increasing wrap's strength of the follower scroll. Besides, in the case of this machine, because the drive scroll and the follower scroll are rotated together, it is supposed that rotation balance can be increased and ability of the machine can be increased.

SUMMARY OF THE INVENTION

Thus, the present invention provides a scroll type fluid machine in which wrap's a strength may be increased, rotation balance may be increased and useless spaces between the wraps may be removed.

Accordingly, the present invention is a scroll type fluid machine comprising a housing, a first scroll unit arranged rotatably in the housing and a second scroll unit rotating with rotation of the first scroll unit and gyrating relative to the first scroll unit in order to vary volumes of compression spaces defined by the first scroll unit and the second scroll unit to absorb and discharge, wherein the first scroll unit comprises a first wrap group constituted of a pair of end plates with support shafts supported rotatably on the housing respectively and a plurality of scrolled wraps arranged uniformly at every specific center angle, and the second scroll unit comprises a cylindrical outer peripheral ring portion held slidably between the pair of the end plates of the first scroll unit, a connection block portion located in a center portion and a second wrap group constituted of a plurality scrolled wraps extending from the ring portion to the connection block portion to define a plurality of insertion spaces into which the wraps of the first wrap group are inserted respectively and forming the compression spaces between the wraps of the first wrap group and themselves. Besides, it is preferred that one of the first scroll unit and the second scroll unit is a drive scroll unit and another of them is a follower scroll unit.

It is preferred that two wraps each of which consists of an involute curve are used in the first wrap group and the second wrap group, that the starting points of them are constituted by being off at $\pi$ (180°), that an extension angle ($\Phi$end) of every terminal portion of the wraps constituting the second wrap group is constituted by increasing $\pi/2$ (90°) from an extension angle ($\Phi$end) of every terminal portion of the wraps constituting the first wrap group.

Furthermore, it is preferred that each center angle is 180°, the first wrap group and the second wrap group are constituted of two wraps respectively, but each center angle may be 120° and the first wrap group and the second wrap group may be constituted of three wraps respectively, and especially the number of the wraps may not be limited.

Besides, it is preferred that intake openings communicating with the compression spaces are formed adjacent to the terminal portions $\Phi$end of the second wraps in the ring portion of the second scroll unit, and that a communication portion communicating with a discharge opening formed in a support shaft is formed in the connection block portion. Note that the communication portion may be in a groove-like style or in a hole-like style.

Thus, in this invention, because the both ends of every wrap of the second wrap group in the second scroll unit are held by the ring portion being on the radial outside and the connection block portion being on the radial inside, so that enough strength is achieved, and further because the second scroll unit is balanced well to a rotation center of the laps, high speed rotation is possible.

Furthermore, since the wraps of the first wrap group are inserted into the insertion spaces defined by the wraps of the second wrap group and since an outer peripheral end Φend of every wrap of the second wrap group is extended to an outer peripheral end Φend of every wrap of the first wrap group, the compression spaces constituted of the first wrap group and the second wrap group can work effectively in outer peripheral walls of outer peripheral ends Φend of the wraps of the first wrap group, so that it is possible to increase a quantity of discharge.

According to the present invention, since rotation balance is good, high speed rotation is possible, and enough quantity of discharge can be obtained, pulsation of discharge fluid can be prevented and it can be possible to correspond to change of discharged quantity quickly.

DETAILED DESCRIPTION OF THE PREFERRED EMBODIMENT

Hereinafter, an embodiment of the present invention is explained with reference to the drawings.

Figure 1:
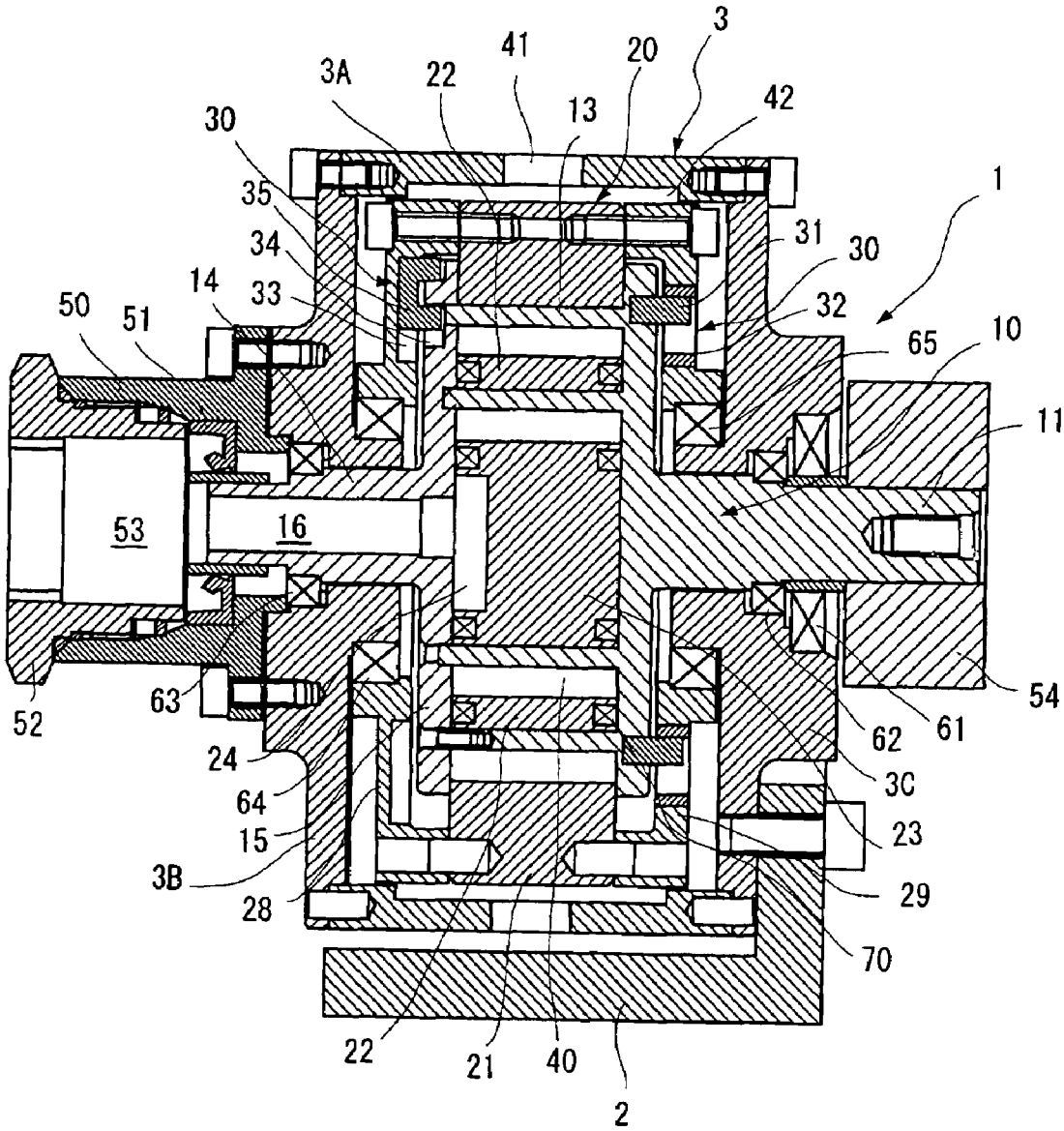
FIG. 1 is a schematic diagram of a scroll type fluid machine according to the present invention.

A scroll type scroll machine 1 according to the present invention comprises, for instance as shown in FIG. 1, at least a housing 3 fixed on a base 2, a first scroll unit (a drive scroll unit in this embodiment) 10 held rotatably on the housing 3 and a second scroll unit (a follower scroll unit in this embodiment) 20 grasped slidably by the drive scroll unit 10 and performing a gyrating movement relative to the drive scroll unit 10 by a rotation synchronous mechanism 30, in which volumes of compression spaces 40 defined by the drive scroll unit 10 and the follower scroll unit 20 are reduced from the outer peripheral side to the center side in turn in order to perform a compression action.

The housing 3 is constituted of a first cylindrical housing 3A, a second housing 3B and a third housing 3C which close both axial ends of the first housing 3A, wherein the second housing 3B and the third housing 3C hold the drive scroll unit 10 rotatably via bearings 62 and 63, respectively. Note that No. 61 indicates an oil seal portion.

Figure 2A:
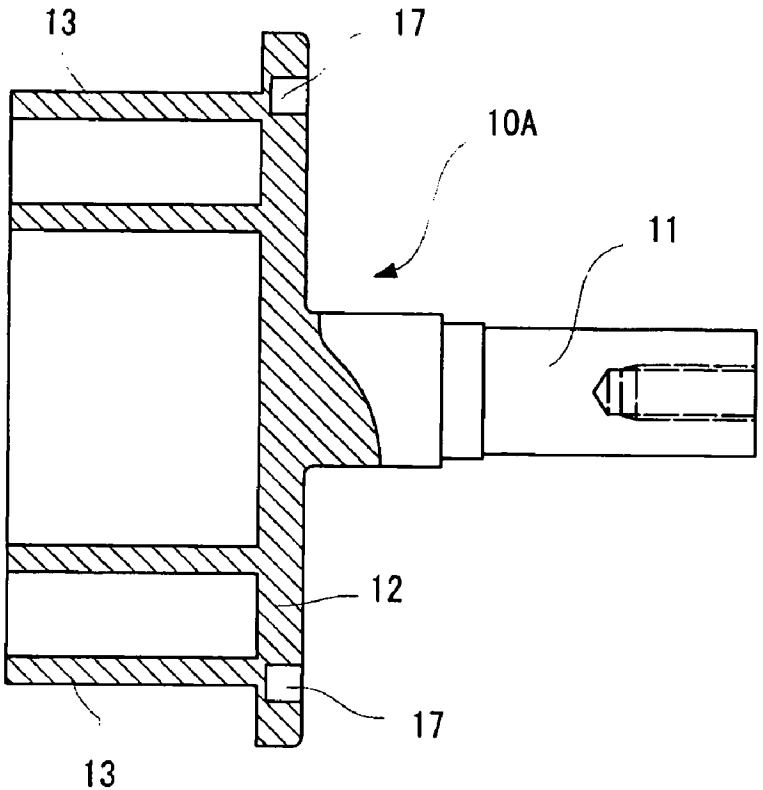
FIG. 2A is a partial cross sectional side elevation and FIG. 2B is its front plan view.
Figure 2B:
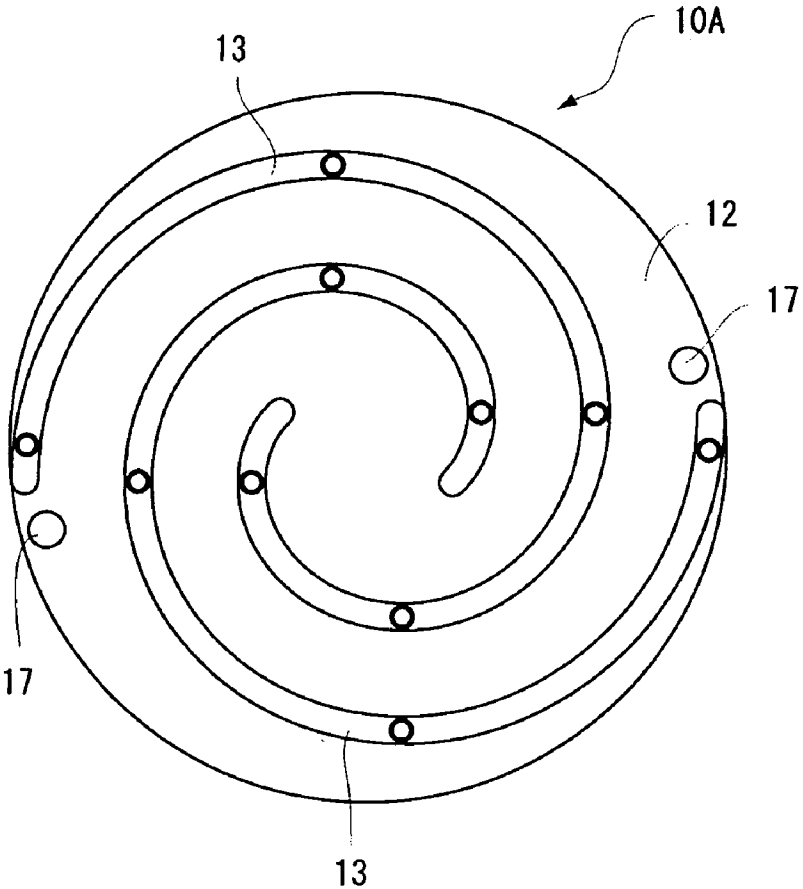
Figure 3A:
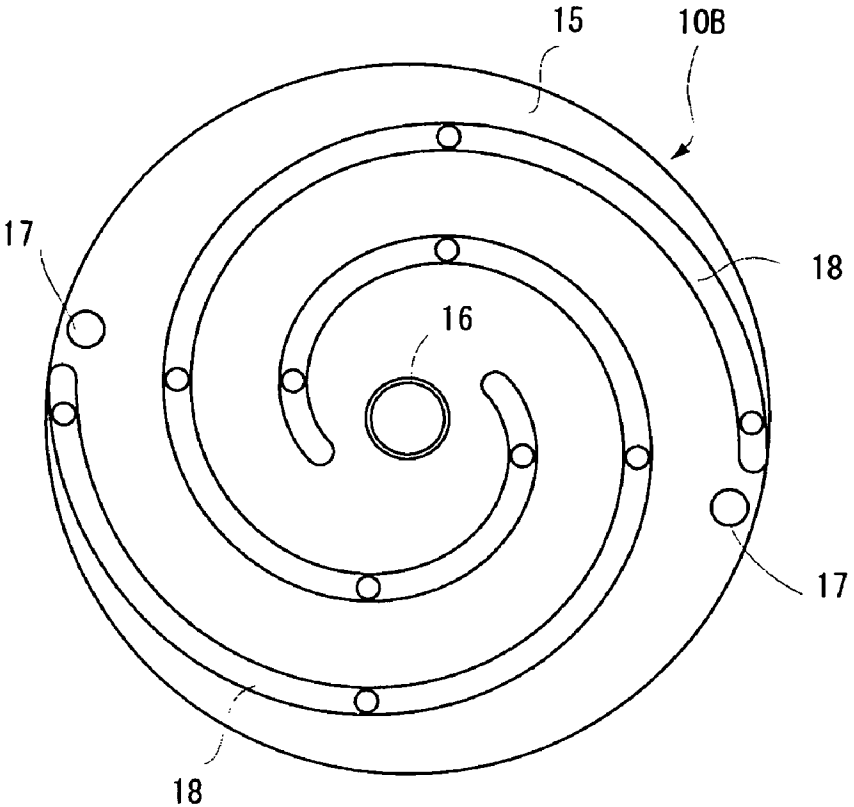
FIG. 3A is a front plan view of a drive scroll receiving member and FIG. 3B is its cross-sectional view.
Figure 3B:
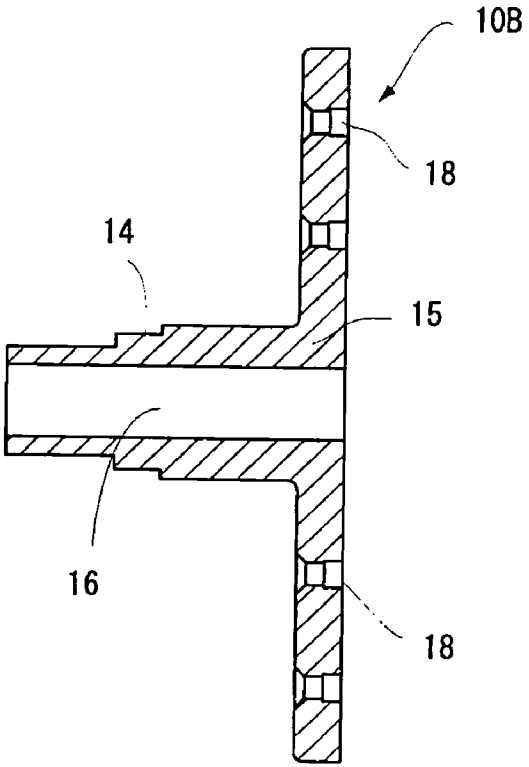

The drive scroll unit 10 is constituted of a first drive scroll member 10A as shown in FIGS. 2A and 2B and a drive scroll receiving member 10B as shown in FIGS. 3A and 3B. The first drive scroll member 10A is constituted of a rotation shaft 11 held rotatably by the third housing 3C via the bearing 62, a first disc-like end plate portion 12 formed integrally with the rotation shaft 11 and a plurality of scrolled wraps (drive wraps) 13 formed integrally with the first end plate portion 12 so as to stand in an axial direction and provided equally at specific angles. Note that the plural drive wraps constitute a first wrap group.

Besides, the drive scroll receiving member 10B is constituted of a supporting shaft 14 supported rotatably by the second housing 3B via the bearing 63 and a second disc-like end plate portion 15 formed integrally with the supporting shaft 14, wherein installing grooves 18, into which axial end portions of the drive wraps 13 are inserted, are formed in the second end plate portion 15 and a discharge hole 16 is formed through the supporting shaft 14. In this embodiment, after installing the follower scroll unit 20 as follows, the drive scroll member 10A and the drive scroll receiving member 10B are secured by screwing. Note that external power is communicated to the rotation shaft 11 via a coupling 54.

Figure 4A:
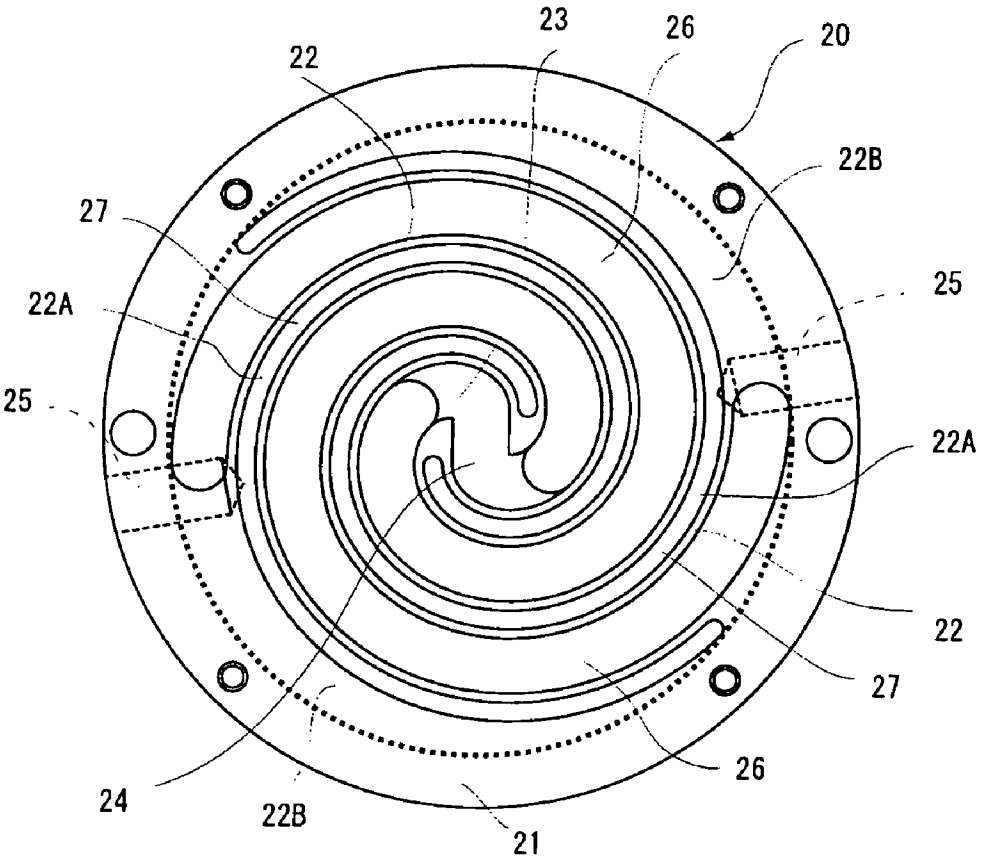
FIG. 4A is a front plan view of a follower scroll receiving member and FIG. 4B is its cross-sectional view.
Figure 4B:
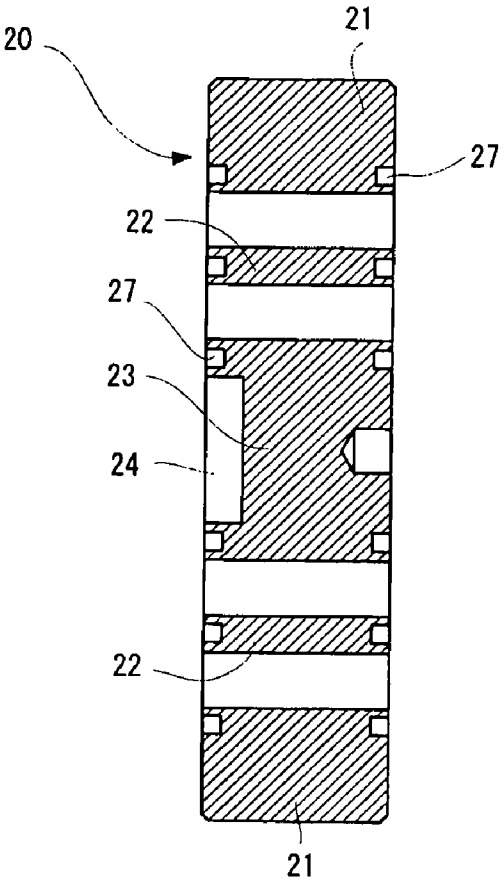

The follower scroll unit 20 is constituted of, as shown in FIGS. 4A and 4B, an outer peripheral ring portion 21 positioned in an outer peripheral portion, a connection block portion 23 positioned in a center portion and a plural wraps (follower wraps) 22 connecting spirally between the outer peripheral ring portion 21 and the connection block portion 23 and defining insertion spaces 26 into which the drive wraps 13 of the first wrap group are inserted. Furthermore, plural compression spaces 40 are defined between the drive wraps 13 and the follower wraps 22 by inserting the drive wraps 13 into the insertion spaces 26.

Figure 5:
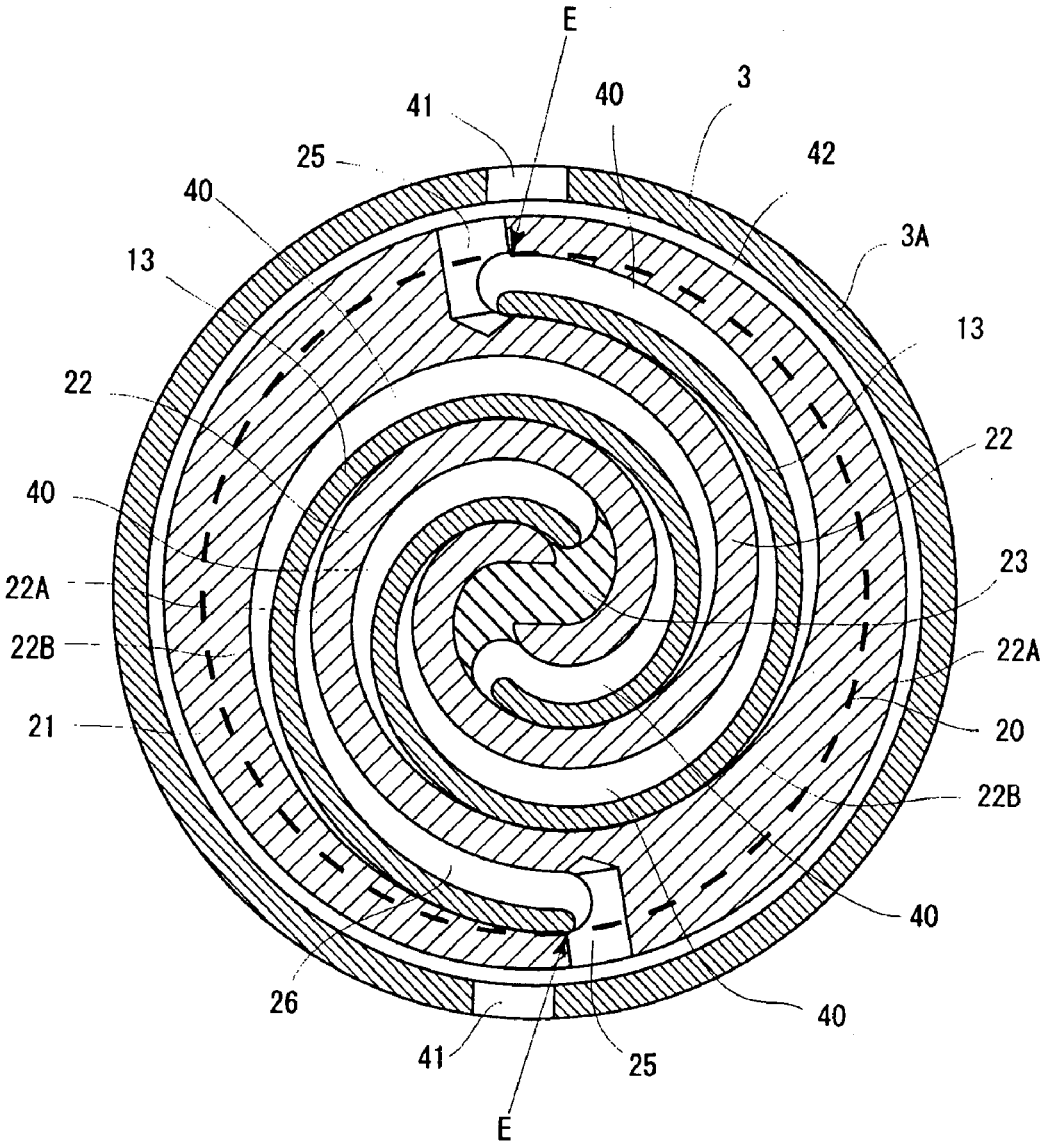
FIG. 5 is an explanatory cross-sectional view showing a structure of the scroll type fluid machine according to the present invention.

Moreover, the follower wraps 22 are constituted of block wrap portions 22B which are formed integrally on the outer peripheral ring portion along the outer peripheral ring portion 21 and in which the insertion spaces 26 are formed along inner peripheral side surfaces thereof, extending wrap portions 22A extended spirally along the insertion spaces 26 from the block wrap portions 22B to the connection block portion 23. A second wrap group is constituted of the plural follower wraps 22. Furthermore, as shown in FIG. 5, end portions of the bock wrap portions 22B of the follower wraps 22, namely the Φend portions E of the follower wraps 22 extend to positions near to the outer peripheral end portions (Φend) respectively. Thus, the outer peripheral walls are used effectively to Φend portions, so that volumes of the compression spaces 40 can be ensured.

Besides, a communication groove 24 communicating between the compression spaces 40 and the discharge hole 16 is formed in the connection block portion 23. Furthermore, installation grooves 27 in each of which seal members 70 are installed are formed on both axial ends of the follower scroll wraps 23, respectively.

Moreover, a pair of scroll receivers (follower scroll receivers) 28 and 29 which are secured adjacent to the outer periphery of the ring portion 21, which are located outside of the both end plate portions 12 and 15 of the drive scroll unit 10 and which are supported rotatably by the second and third housings 3B and 3C via bearings 64 and 65 are provided in the follower scroll unit 20.

Besides, an oil seal member 51 is provided on an outer peripheral edge of the supporting shaft 14 and an oil seal receiver 50 holding the oil seal member 51 is fixed on the second housing 3B. Furthermore, a cap portion 52 is provided on an end portion of the oil seal receiver 50 and a discharge opening 53 communicating with the discharge hole 16 is formed in the cap portion 52.

Rotation synchronous mechanisms 30 are provided between the end plate portions 12, 15 of the drive scroll unit 20 and the follower scroll receivers 28, 29, respectively. One example of the rotation synchronous mechanisms 30 is what is constituted of SP pins 31 and SP rings 32 with which the SP pins 31 are engaged or what is constituted of Oldham's grooves 34 which are formed on the end plate portions 12, 15, Oldham's grooves 33 which are formed in the follower scroll receivers 28, 29 and Oldham's sliders engaging with the Oldham's grooves 33, 34, as shown in FIG. 1. However, any one of the rotation synchronous mechanisms may be provided, but any other rotation synchronous mechanism may be used.

By the above-mentioned constitution, as shown in FIGS. 1 and 5, gas or liquid (hereinafter, fluid) is absorbed from the intake openings 41 formed in the first housing 3A of the housing 3 via the intake holes 25 through an inner space 42 defined by the housing 3 in an enlarging process of the compression spaces 40, is compressed in a reduction process performed with movement of the compression spaces 40 to a center direction, and is discharged from the communication groove 23 in the center end portions through the discharge hole 16 and the discharge opening 53.

The scroll type fluid machine due to the above-mentioned constitution can be used as an air pump because air can be compressed and discharged by opening the intake openings to the open air. Besides, it can be used as an air blower which can be used in a scattering system of water drops and the like.

Furthermore, the scroll type fluid machine can be used as an oil pump, a water pump or a vacuum pump in which liquid is absorbed and discharged by providing a piping system to the intake openings.

Moreover, the scroll type fluid machine is used in a turbo system of an internal-combustion engine because it can respond to rapid change of rotation speed and rapid change of requirement to desired discharge volume according to good rotation balance thereof.

What is claimed is:

1. A scroll type fluid machine comprising a housing, a first scroll unit rotatably installed in said housing and a second scroll unit gyrating relatively to said first scroll unit with rotation of said first scroll unit and changing volumes of compression spaces defined by said first scroll unit and said second scroll unit in order to absorb and discharge, wherein:

said first scroll unit comprises a pair of end plates with support shafts supported rotatably on said housing respectively and a first wrap group constituted of plural spiral wraps which are secured between said end plates and arranged at equal angular intervals, and said second scroll unit comprises a cylindrical peripheral ring portion held slidably between said pair of end plates of said first scroll unit, a connection block portion located in a center portion thereof and a second wrap group constituted of plural spiral wraps which extend from said ring portion to said connection block portion to define a plurality of insertion spaces into which said wraps of said first wrap group are inserted respectively and which form the compression spaces between the wraps of the first warp group and the second wrap group.

2. A scroll type fluid machine according to claim 1, wherein two wraps, each of which consists of an involute curve, are used in the first wrap group and the second wrap group and the starting points thereof are offset from each other by $\pi$ (180°).

3. A scroll type fluid machine according to claim 2, wherein an extension angle ($\Phi$end) of every terminal portion of said wraps constituting said second wrap group is constituted by increasing $\pi/2$ (90°) from an extension angle ($\Phi$end) of every terminal portion of the wraps constituting the first wrap group.

4. A scroll type fluid machine according to claim 3, wherein intake openings communicating with the compression spaces are formed adjacent to the terminal portions of the second wraps in the ring portion of the second scroll unit, and a communication portion communicating with a discharge opening formed in said support shaft is formed in said connection block portion.

5. A scroll type fluid machine according to claim 1, wherein an extension angle ($\Phi$end) of every terminal portion of said wraps constituting said second wrap group is constituted by increasing $\pi/2$ (90°) from an extension angle ($\Phi$end) of every terminal portion of the wraps constituting the first wrap group.

6. A scroll type fluid machine according to claim 5, wherein intake openings communicating with the compression spaces are formed adjacent to the terminal portions of the second wraps in the ring portion of the second scroll unit, and a communication portion communicating with a discharge opening formed in said support shaft is formed in said connection block portion.

7. A scroll type fluid machine according to claim 1, wherein intake openings communicating with the compression spaces are formed adjacent to the terminal portions of the second wraps in the ring portion of the second scroll unit, and a communication portion communicating with a discharge opening formed in said support shaft is formed in said connection block portion.

* * * * *